US007694829B2

(12) United States Patent
Veltri et al.

(10) Patent No.: US 7,694,829 B2
(45) Date of Patent: Apr. 13, 2010

(54) SETTLING VESSEL FOR EXTRACTING CRUDE OIL FROM TAR SANDS

(76) Inventors: Fred J. Veltri, 6526 S. River Edge La., Murray, UT (US) 84123; John B. Fairbanks, 4277 S. 390th East, Salt Lake City, UT (US) 84107

( * ) Notice: Subject to any disclaimer, the term of this patent is extended or adjusted under 35 U.S.C. 154(b) by 0 days.

(21) Appl. No.: 11/936,695

(22) Filed: Nov. 7, 2007

(65) Prior Publication Data

US 2008/0110803 A1 May 15, 2008

Related U.S. Application Data

(60) Provisional application No. 60/865,263, filed on Nov. 10, 2006.

(51) Int. Cl.
*B01D 17/028* (2006.01)

(52) U.S. Cl. ..... 210/521; 210/532.1; 210/540

(58) Field of Classification Search ..... 210/521, 210/522, 523, 532.1, 534, 535, 536, 537, 210/538, 540

See application file for complete search history.

(56) References Cited

U.S. PATENT DOCUMENTS

| | | | | |
|---|---|---|---|---|
| 1,312,266 | A | 8/1919 | Navin | |
| 1,615,121 | A | 1/1927 | Fyleman | |
| 1,760,229 | A * | 5/1930 | Arndt | 210/532.1 |
| 1,791,797 | A | 2/1931 | Clark | |
| 2,354,856 | A * | 8/1944 | Erwin | 210/522 |
| 2,903,407 | A | 9/1959 | Fischer | |
| 2,921,010 | A | 1/1960 | Sherborne | |
| 2,924,565 | A | 2/1960 | Stegemeier | |
| 2,924,566 | A | 2/1960 | Vaell | |
| 2,957,818 | A | 10/1960 | Fischer | |
| 2,968,603 | A | 1/1961 | Coulson | |
| 2,980,600 | A | 4/1961 | Kelley | |
| 3,041,267 | A | 6/1962 | Frame | |
| 3,052,621 | A | 9/1962 | Clark | |
| 3,075,913 | A | 1/1963 | Scheffel | |
| 3,152,979 | A | 10/1964 | Bichard | |
| 3,159,562 | A | 12/1964 | Bichard | |
| 3,184,065 | A * | 5/1965 | Bradford | 210/535 |
| 3,208,930 | A | 9/1965 | Andrassy | |
| 3,271,293 | A | 9/1966 | Clark | |
| 3,291,717 | A | 12/1966 | White | |

(Continued)

OTHER PUBLICATIONS

Veltri, F.J., and J.B. Fairbanks, "Continuous Flow Separation and Aqueous Solution Treatment for Recovery of Crude Oil from Tar Sands," U.S. Appl. No. 11/936,690, filed Nov. 7, 2007.

(Continued)

*Primary Examiner*—Christopher Upton
(74) *Attorney, Agent, or Firm*—Christensen O'Connor Johnson Kindness PLLC

(57) ABSTRACT

Process and apparatus for the continuous separation of crude oil from tar sands include using a hydrocarbon diluent and an aqueous solution in one or more settling vessels. The light components from the oil are collected and recycled to be used as the hydrocarbon diluent, and the aqueous solution is collected and recycled. A second aqueous solution is introduced in the second and subsequent vessels to prevent the formation of an oil film on the equipment.

6 Claims, 3 Drawing Sheets

U.S. PATENT DOCUMENTS 3,296,117 A 1/1967 Ross
3,401,110 A 9/1968 Floyd
3,594,306 A 7/1971 Dobson
3,644,194 A 2/1972 Keely
3,660,268 A 5/1972 Kelly
3,726,786 A 4/1973 Given
3,738,929 A 6/1973 Terry
3,751,358 A 8/1973 Elliott
3,808,120 A 4/1974 Smith
3,846,276 A 11/1974 Walker
3,847,789 A 11/1974 Cymbalisty
3,893,907 A 7/1975 Canevari
3,931,006 A 1/1976 Baillie
3,933,654 A * 1/1976 Middelbeek ..... 210/521
3,948,755 A 4/1976 McCollum
3,951,749 A 4/1976 Fairbanks, Jr.
3,951,778 A 4/1976 Willard, Sr.
3,953,318 A 4/1976 Baillie
3,963,599 A 6/1976 Davitt
4,005,005 A 1/1977 McCollum
4,017,377 A 4/1977 Fairbanks, Jr.
4,035,282 A 7/1977 Stuchberry
4,067,796 A 1/1978 Alford
4,094,768 A 6/1978 Fuller
4,098,674 A 7/1978 Rammler
4,110,195 A 8/1978 Harding
4,120,776 A 10/1978 Miller
4,120,777 A 10/1978 Globus
4,133,742 A 1/1979 Hill
4,160,428 A 7/1979 Wilkinson
4,160,718 A 7/1979 Rendall
4,172,025 A 10/1979 Porteous
4,240,897 A 12/1980 Clarke
4,250,016 A 2/1981 Estes
4,270,609 A 6/1981 Choules
4,325,802 A 4/1982 Porter
4,338,185 A 7/1982 Noelle
4,368,111 A 1/1983 Siefkin
4,392,941 A 7/1983 Roth
4,396,508 A * 8/1983 Broughton ..... 210/522
4,399,039 A 8/1983 Yong
4,399,314 A 8/1983 Child
4,415,434 A 11/1983 Hargreaves
4,424,112 A 1/1984 Rendall
4,427,528 A 1/1984 Lindorfer
4,459,200 A 7/1984 Dente
4,486,294 A 12/1984 Miller
4,512,872 A 4/1985 Chung
4,533,459 A 8/1985 Dente
4,702,487 A 10/1987 Stoian
4,719,008 A 1/1988 Sparks
4,747,947 A * 5/1988 Bannon ..... 210/522
4,765,885 A 8/1988 Sadeghi
4,776,949 A 10/1988 Leung
4,778,591 A 10/1988 Reynolds
4,783,268 A 11/1988 Leung
4,816,146 A * 3/1989 Schertler ..... 210/522
4,822,481 A 4/1989 Taylor
4,846,275 A 7/1989 McKay
4,891,131 A 1/1990 Sadeghi
4,929,341 A 5/1990 Thirumalachar
4,961,843 A * 10/1990 Lewis ..... 210/521
4,966,685 A 10/1990 Hall
4,968,413 A 11/1990 Datta
5,017,281 A 5/1991 Sadeghi
5,143,598 A 9/1992 Graham
5,186,820 A 2/1993 Schultz
5,244,000 A 9/1993 Stanford
5,320,741 A 6/1994 Johnson
5,320,746 A 6/1994 Green
5,322,617 A 6/1994 de Bruijn
5,326,456 A 7/1994 Brons
5,480,566 A 1/1996 Strand
5,492,628 A 2/1996 Schutte
5,520,825 A * 5/1996 Rice ..... 210/540
5,626,743 A 5/1997 Humphreys
5,645,714 A 7/1997 Strand
5,723,042 A 3/1998 Strand
5,770,049 A 6/1998 Humphreys
5,846,314 A 12/1998 Golley
5,985,138 A 11/1999 Humphreys
6,007,709 A 12/1999 Duyvesteyn
6,019,888 A 2/2000 Mishra
6,074,558 A 6/2000 Duyvesteyn
6,164,458 A * 12/2000 Mandrin et al. ..... 210/521
6,251,290 B1 6/2001 Conaway
6,491,830 B1 * 12/2002 Batten et al. ..... 210/540
7,090,768 B2 8/2006 Page
7,144,516 B2 * 12/2006 Smith ..... 210/523
2001/0030145 A1 10/2001 Conaway
2002/0104799 A1 8/2002 Humphreys
2003/0205507 A1 11/2003 Mikula
2004/0031731 A1 2/2004 Honeycutt
2004/0035755 A1 2/2004 Reeves
2004/0129633 A1 * 7/2004 Edmondson ..... 210/521
2004/0222164 A1 11/2004 Conaway
2005/0161372 A1 7/2005 Colic
2005/0194292 A1 9/2005 Beetge
2006/0076273 A1 4/2006 Cobb
2006/0249431 A1 11/2006 Cymerman

OTHER PUBLICATIONS

Veltri, F.J., and J.B. Fairbanks, "Composition for Extracting Crude Oil from Tar Sands," U.S. Appl. No. 11/936,691, filed Nov. 7, 2007.
Veltri, F.J., and J.B. Fairbanks, "Slurry Transfer Line," U.S. Appl. No. 11/936,698, filed Nov. 7, 2007.

* cited by examiner

SETTLING VESSEL FOR EXTRACTING CRUDE OIL FROM TAR SANDS

CROSS-REFERENCE TO RELATED APPLICATION

This application claims the benefit of Provisional Application No. 60/865,263, filed Nov. 10, 2006, incorporated herein by reference in its entirety.

BACKGROUND

As the need for energy continues to increase, the supply of easily accessible oil reserves steadily decreases. Accordingly, there exists a need to replace the diminishing supplies of oil reserves. Tar sands have been studied extensively over the past two decades as a source for oil. Many of the conventional processes for recovering oil from tar sands use large quantities of heat to aid in separation of the oil from the tar sands. The cost of heating makes many of these processes uneconomical. A process to separate oil from tar sands has not yet been developed that is feasible or economically viable to compete with the currently available sources of oil.

SUMMARY

In order to provide for additional oil reserves, the present invention is related to a process for the recovery of oil from tar sands, shale, or other oil bearing materials.

In one embodiment of the present invention, a continuous flow separation method for the recovery of crude oil from tar sands, shale, or other oil bearing materials is provided. The method uses two different aqueous compositions to achieve separation.

In another embodiment of the present invention, a composition used in the separation of oil from tar sands, shale, or other oil bearing materials is provided.

In another embodiment of the present invention, a slurry transfer line for the transfer of tar sands, shale, or other oil bearing materials through lines and bends in lines is provided.

In another embodiment of the present invention, a settling vessel for the separation of oil from tar sands, shale, or other oil bearing materials is provided.

The recovery of oil from tar sands, shale, or other oil bearing materials as described herein uses less water, little to no heat, and the initial separation of the oil from the sand is accomplished by thinning the bitumen or oil and washing this bitumen or oil from the sand with aqueous solutions to separate oil from the sand.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
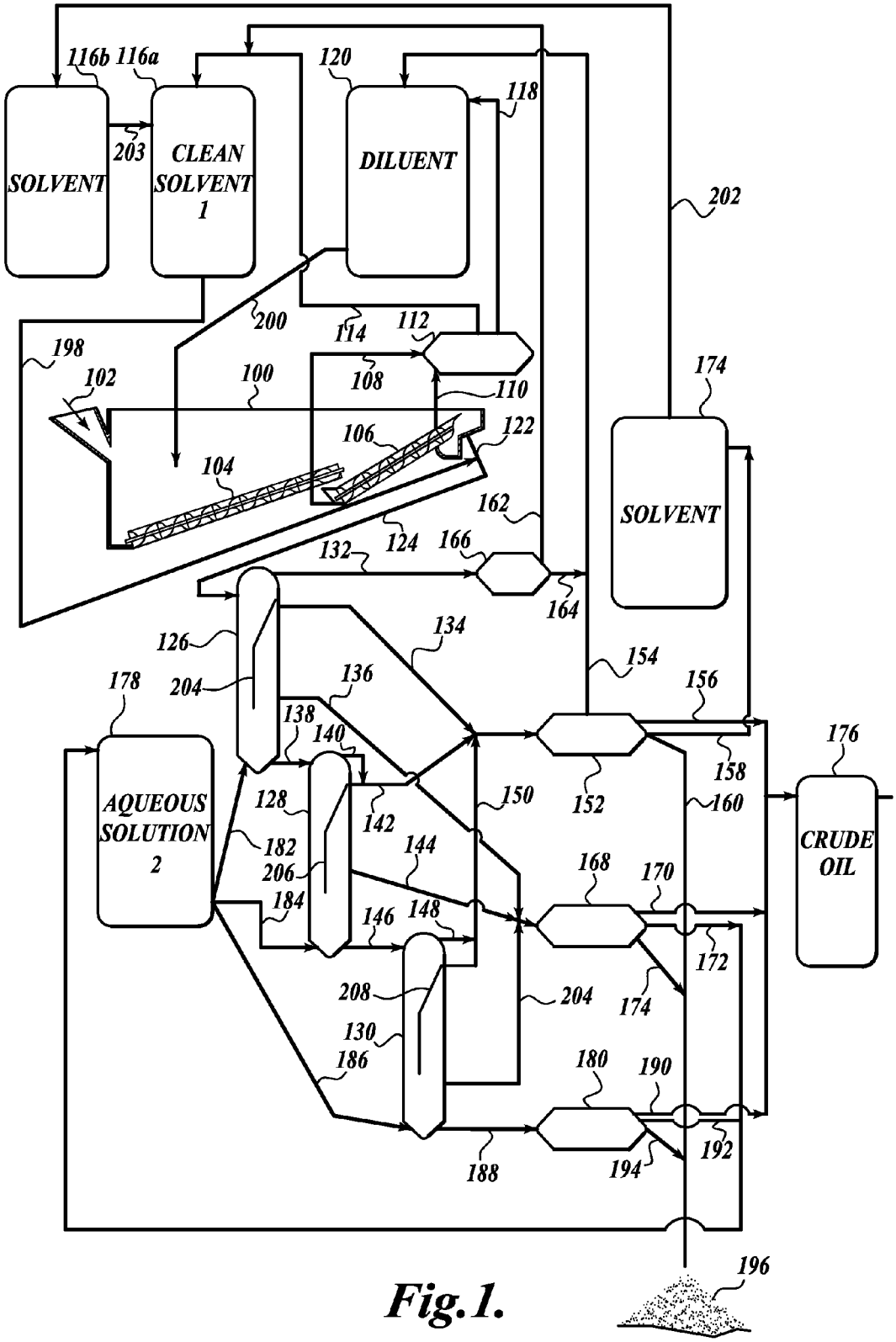
FIG. 1 is a flow diagram of a continuous process for the recovery of oil from tar sands, shale, or other oil bearing materials using a first and second aqueous composition in accordance with one embodiment of the present invention.

A process for the separation and recovery of oil from tar sands includes washing the oil from the tar sands with an aqueous solution of a wetting agent and a specific gravity enhancing agent to adjust the pH to a range of about 11.2 to about 12.0 and the specific gravity to a range of about 1.07 to about 1.01. In this application, tar sands are used as one representative example of oil containing material. Other materials include shale, oil sands, etc. In the above-described range of pH and specific gravity, the oil will separate from the tar sands and due to the difference in the specific gravity of oil and water, the oil and water will respectively separate into different fractions. The washing treatment may take place in specially designed slurry transfer lines where aqueous solution is injected to wash the tar sands, followed by one or more settling vessels in series. Each subsequent settling vessel can recover the residual oil left on the sand by the previous settling vessel. To this end, the settling vessels can have an outlet for the oil, an outlet for the aqueous solution, and an outlet for the sand. Because some oil may be entrained in the aqueous solution and vice versa, once the oil and aqueous solution are removed from the settling vessel, the flows may be further processed in mechanical centrifuges to achieve a higher purity oil without water and to cleanse the aqueous solution of oil to be reused and recycled. The settling vessels are designed to operate under liquid filled conditions and under pressure so that the use of mechanical pumps may be avoided in the transfer of flows from one vessel to the next. The process for the separation and recovery of oil from tar sands may include adding a hydrocarbon diluent to tar sands to start the cycle of breaking down, thinning, and/or softening the oxidized coating of oil on the sand. This is followed by washing the oil from the sand with an aqueous solution of a wetting agent to adjust the pH and a salt to adjust the specific gravity to achieve a pH in the range of about 11.2 to about 12.0 and a specific gravity of in the range of about 1.07 to about 1.01. In the process according to one embodiment of the present invention, two compositions for the aqueous solution are used. The hydrocarbon diluent is removed before the first aqueous solution is introduced to the tar sands. Diluents are the light components collected from the oil during processing. The light components have relatively low molecular weight.

After treatment with a hydrocarbon diluent, the first aqueous solution is used to wash the tar sands and the mixture is sent to a first settling vessel. The light oils separate from the heavy oils and can be collected and used as the hydrocarbon diluent. The aqueous solution specific gravity is higher in comparison with the oil, which allows oil droplets to float on the surface of the aqueous solution. The aqueous solution allows the oil droplets to break down into heavy oil (API gravity of 8-15) and light oils (API gravity of 25 to 28). The heavier oil droplets do not float quite as quickly as do the lighter oil droplets, allowing for the collection of the lighter oil droplets for recycling to be used as a hydrocarbon diluent, where they are introduced with the crushed tar sands, assisting in the softening of the thin coating of the oil on each grain of sand. This step improves the separation without the use of an outside diluent reducing the cost of operation, and allowing 97%-100% of the oil to be recovered and allowing for more uses of the clean sand.

If the aqueous solution specific gravity has not been raised or has not been raised within the appropriate parameters, much of the heavy oil will descend with the sand to the bottom of the tank. This heavy oil will be washed and separated from the sand but will descend to the bottom of the settling vessel where it will be moved with the sand into the second and third settling vessels, where the adjustments to the aqueous solution will need to be made so that the oil can be collected or the oil will stay with the sand and collect into small balls about ½" to 1" in size coated with the sand.

Because oil sands deposits are made up of different soil and sand compounds, the composition of the sand will vary from site to site. This means that the percentage of clays, calcium, silica, alkali, slats and acidity will vary from deposit to deposit. This also means to attain clean middlings, the pH as well as the specific gravity of the aqueous solutions is preferably monitored. The specific gravity and pH can be monitored in the first and second aqueous solution tanks, settling vessels, slurry transfer lines, etc.

The pH of the aqueous solution/oil/tar sand mixture in each of the one or more washing steps should be kept between about 11.2 to about 12.0. Separation of oil from the tar sands may begin during washing in the slurry transfer lines, and is continued in the settling vessels, where more concentrated fractions of the oil is collected. The specific gravity of the mixture in each of the one or more washing steps should be kept between about 1.07 to about 1.01. All constituents of the mixture should be considered. This includes any hydrocarbon diluent, water, chemicals and compounds found in the soils, and the oil sands deposit.

The increased specific gravity of the aqueous solution will ensure that the oil drops rise quickly to the top of the settling vessel. If the aqueous solution's specific gravity has not been raised, then much of the oil will descend with the sand to the bottom of the settling vessel. If the specific gravity is raised too much, then the fine sands and clays will stay suspended in the middlings, causing cloudy or muddy middlings.

The premixing of the hydrocarbon diluent with the tar sands is accomplished by dumping the crushed tar sand into a sealed pressurized hopper that prevents any light ends (Hempel-Engler distillation points between 100° and 174° Fahrenheit) from being released into the atmosphere. This hopper has large screw conveyors that turn over the sand, allowing the hydrocarbon diluent to coat the tar sands. The screw conveyors also move the sand up an incline where the excess hydrocarbon diluent is allowed to drain off from the tar sand to be collected and reused. From the hopper, the tar sands can now be moved into a settling vessel under pressure with the first aqueous solution. The tar sands are in a slurry, therefore, to move the slurry from the hopper to the first settling vessel, a specially designed slurry transfer line or pipe is used. The lightly coated oil sand moves through the slurry line where washing with the first aqueous solution will take place. The first of two aqueous bath solutions is applied at a rate of between 30% to about 35% aqueous solution and about 65% to about 70% oil sands. This aqueous bath solution has a slightly raised specific gravity and will move the oil sands through the first slurry line and at the same time, the movement of the aqueous bath through the slurry line will help wash the oil from the sand, releasing the hydrocarbons (crude oil) through attrition. (An ultrasonic collar fitted around the discharged slurry line can help to increase separation.) Periodically, along the slurry line additional aqueous bath is injected into the mixture to help turn the oil sand mixture aiding in the washing and also to keep the sand from eroding the inside of the line. The line includes a plurality of injection nozzles arranged in a helical pattern around the circumference of the slurry transfer line. The aqueous solution is injected via the nozzles. The aqueous solution is thereby churned at a very low speed with the specially designed slurry line so as to minimize any derogation of the grains of sand. This can be an advantageous step in the process because the sand encapsulated in the oil is usually of very fine grains, including particles of between 200 microns to 350 microns in diameter. The smaller the grains of sand, the thinner the viscosity of the oil should be to allow the sand to drop out of suspension. If the sand is allowed to become even more derogated, the oil will need additional treatment to allow these fine sand particles to drop out of suspension. After a predetermined time for the churning of the tar sands in the slurry line (determined by the percentage of oil to sand ratio and the size of sand particles) to allow for the washing of the oil from the sand, the solution and tar sands are purged into a sealed settling vessel (or separation vessel) where the oil is allowed to rise and the sand is allowed to drop. The transfer of slurry into the settling vessel may be continuous. The oil collects towards the top of the settling vessel and is drawn off to be de-watered (a step by which the aqueous solution is removed from the oil) by a centrifuge, for example. The oil is allowed to naturally separate into the heavy and light crude/bitumen, with the lighter oil moving to the uppermost portion of the settling vessel where a portion of the light crude will be drawn off and transferred back to the beginning of the process where it is used as the hydrocarbon diluent and mixed with the tar sands to thin the oil coating the sand in the hopper. The balance of the lighter oil and the heavier oil are then transferred to a holding tank, again sealed, where it is held for transporting to a refinery. The aqueous solution is cleaned and recycled back to holding tanks where it is tested for concentration. Adjustments in the form of adding a wetting agent and specific gravity enhancing agent may be made at this point, and then the aqueous solution may be injected into the slurry transfer lines where it is introduced to the tar sand and churned. The sand that has settled to the bottom of the first settling vessel is drawn and sent to a second settling vessel by way of the specially designed slurry line. These steps may be repeated any number of times to recover any residual oil from the sand. For the second and subsequent times, the aqueous solution may be changed and injected into the system for the purpose of eliminating coating the lines, tanks, and centrifuges with oil. The second and third washing of the tar sands will use a second aqueous solution of different composition than the first aqueous solution. The amount of second aqueous solution to use in the second and third settling vessels is about 45% to about 50% of the second aqueous solution and about 50% to about 55% tar sands, for example.

When the above process is followed, the hydrocarbon diluent acts to initially break down the bond of the oil to the sand by diluting and/or softening the oil by reducing the oil viscosity. The hydrocarbon diluent, including natural naphtha/light ends, acts to thin the oil and allow the sand grains to be washed with aqueous solutions by allowing a thin coat of the aqueous solution to coat the sand grains. Once the sand is coated with the aqueous solution, the oil will not reattach to the sand because of the natural repelling action between oil and water, allowing for the efficient separation of the oil and sand.

In the process, a first and a second aqueous solution is used of varying compositions. The first aqueous solution is used in the first settling vessel, the second aqueous solution is used in subsequent settling vessels. The first and second aqueous solutions comprise a wetting agent and a specific gravity enhancing agent. A preferable wetting agent is sodium metasilicate pentahydrate. A preferable specific density enhancing agent is soda ash lite anhydrous. The first aqueous solution is made by adding to water about 20 to 68 grams, preferably about 34.5 grams of sodium metasilicate pentahydrate, about 2 to 7 grams, preferably about 3.5 grams of soda ash lite anhydrous, and about 0 to 7 grams, preferably about 5 grams ($2.2\times10^{-6}$ weight fraction) of sodium bicarbonate anhydrous for every gallon of water (about 3781 grams) to make the concentrated solution. Then, 6.4 ml (about 128 drops) of the concentrated solution are added for every gallon of water to make the solution used in the process. Accordingly, the first aqueous solution used in the process has the dissolution products of about 20 to 68 grams ($9\times10^{-6}$ to $3\times10^{-5}$ weight fraction), preferably about 34.5 grams of sodium metasilicate pentahydrate, about 2 to 7 grams ($9\times10^{-7}$ to $3\times10^{-6}$ weight fraction), preferably about 3.5 grams of soda ash lite anhydrous, and about 0 to 7 grams (0 to $3\times10^{-6}$ weight fraction), preferably about 5 grams ($2.2\times10^{-6}$ weight fraction) of sodium bicarbonate anhydrous for about every 2,242 kg of water. It should be appreciated that when added to water, sodium metasilicate pentahydrate, soda ash lite anhydrous, and sodium bicarbonate anhydrous will dissolve into products of dissolution, including ions.

The second aqueous solution is made by adding to water about 0.7 to 30 grams, preferably about 15.1 grams (1/16 cup) of sodium metasilicate pentahydrate and about 7 to 14 grams, preferably about 11.3 grams (1 teaspoon) soda ash lite anhydrous for every gallon of water (about 3781 grams) to make the concentrated solution. Then, 3.85 ml of the concentrated solution are added for every gallon of water to make the solution used in the process. Accordingly, the second aqueous solution used in the process has the dissolution products of about 0.7 to 30 grams ($1.8\times10^{-7}$ to $8\times10^{-6}$ weight fraction), preferably about 15.1 grams (1/16 cup) of sodium metasilicate pentahydrate and about 7 to 14 grams ($1.8\times10^{-6}$ to $3.6\times10^{-6}$ weight fraction), preferably about 11.3 grams (1 teaspoon) soda ash lite anhydrous for about every 3,724 kg of water.

Generally, there are two grades of soda ash—soda ash lite and soda ash dense. In one embodiment, soda ash lite is characterized as d50 100 microns (quicker dissolving). Soda ash dense is characterized as d50 300-500 microns. Both can be used in the process and should not affect the end result. Sodium chloride (NaCl) may be used instead of sodium metasilicate pentahydrate. Other wetting agents and specific density enhancing agents besides sodium metasilicate pentahydrate and soda ash may be used, but do not have the advantages of preventing oil from coating the interior of the lines, vessels, and centrifuges, causing the system to clog and fail. If other aqueous solutions are used, then the hydrocarbon diluent should be added to the hopper to thin the oil coating on the sand, but increasing the cost of operation and affecting the optimum cleaning and separation. The hydrocarbon diluent is the product of the breaking down of the oil into heavy and light components which occurs to create a natural naphtha from the oil that is useful for this process and allows for optimum separation. This natural naphtha generated from the oil in the tar sands without refining will not create an environmental problem because it is not generated by an outside refining process, and no outside hazardous materials are added. The components used for the aqueous solution are dissolved and absorbed into the water and become a water mixture and will not mix with the oil and will stay suspended in the water for recycling of the aqueous solution.

In some instances, the tar sands may be combined with diatomaceous earth, or alternatively, the oil can be attached to diatomaceous earth. A typical chemical composition of diatomaceous earth is about 86% silica, about 5% sodium, about 3% magnesium, and about 2% iron. Because of the high percentage of silica, there may be no need to add sodium metasilicate pentahydrate to the aqueous solution, as long as the specific gravity and the pH stay within the specified range of about 11.2 to about 12.0 for pH and about 1.07 to about 1.01 for specific gravity. Accordingly, if analysis of the tar sands indicates a high percentage of silica, the sodium metasilicate pentahydrate may be omitted. This is advantageous from reducing the use of chemicals and as the overall cost of the process becomes lower.

The heavy oils may have a tendency to coat/collect on the inside wall of the slurry lines, settling vessels and centrifuges, etc., causing the lines and equipment to become restricted and eventually fail, shutting down the process. This coating can be eliminated by the process of flushing the entire system with the second aqueous solution (sodium metasilicate, soda ash) for 5 minutes before starting the process. Once every hour, the system should then be flushed with the second aqueous solution for one to several minutes without any tar sands. Lines for carrying sand are designed to eliminate this problem by having aqueous solution injected along the line into the slurry to help turn the tar sand mixture aiding in washing and also to keep the sand from eroding the inside of the pipeline or settling on the bottom of the line. The sands particles are of a fine nature, generally in the size of about 200 microns to about 350 microns. The second aqueous solution (sodium metasilicate, soda ash) should also be flushed through the system before the system is to be shut down for any excessive length of time.

Referring to FIG. 1, a process flow diagram is illustrated showing one embodiment of a continuous process and system for the separation of oil from tar sands. The process may also be used in the separation of oil from shale, or other oil bearing materials. The system includes a tank for collecting and distributing the first aqueous solution. In the illustrated embodiment, several tanks are used for this purpose, including tanks 174, 116*a*, and 116*b*, all having a first aqueous solution of a first composition. Tank 116*b* is mainly for adjusting the pH and specific gravity by adding, for example, sodium metasilicate pentahydrate and soda ash, before transferring to the tank 116*a*. The tank 178 is used to collect and distribute the second aqueous solution of a second composition. In addition to the aqueous solution tanks, the system includes recycled light ends (hydrocarbon diluent) tank 120 and a crude oil tank 176. Additionally, the system includes several settling vessels 126, 128, and 130. However, fewer or more settling vessels may be used. The system includes a number of separators, such as centrifuges, that are placed downstream from the settling vessels. Centrifuges are denoted by the unit operations labeled 112, 166, 152, 168, and 180.

Tar sands 102 can be mined from open pits and loaded to a crusher wherein the tar sands are reduced to approximately one-quarter to one-half inch size chunks for use in the process.

A hopper 100 includes a first and a second screw conveyor 104 and 106 disposed at an incline followed by a filter 112.

The outlet of screw conveyor 104 feeds the inlet of screw conveyor 106. Hopper 100 is for treating the tar sands with a fine mist of hydrocarbon diluent from tank 120 to reduce the internal fluid friction and viscosity of the oil layers surrounding each particle of sand to soften the outer layer. The mist is injected via line 200. Tar sands 102 or crushed shale, having about 1% to 13% water, is added into the inlet of the hopper 100. Within the hopper 100, the tar sands 102 are contacted with hydrocarbon diluent from diluent tank 120. The tar sand material and hydrocarbon diluent is conveyed via the first inclined screw conveyor 104 to the top of the screw conveyor 104 where the material falls into the inlet of the second inclined screw conveyor 106. The tar sands 102 are turned over by screws 104 and 106 to allow for a more even coating before being transferred to the settling cylinders. The hydrocarbon diluent can be collected both at the inlet and the outlet of the second screw conveyor 106 and sent to filter 112.

The hydrocarbon diluent (API gravity of 25 to 28) from the tank 120 is carried via line 200 into hopper 100. The hydrocarbon diluent is sprayed as a fine mist on the incoming tar sands 102. At the entrance to the second screw conveyor 106, hydrocarbon diluent is removed via the line 108 and transferred to the filter 112. Material falling into the inlet of the second screw conveyor 106 is conveyed to the top of screw conveyor 106 and deposited into line 122. Hydrocarbon diluent from the end of screw conveyor 106 is transferred to filter 112 via the line 110. Filter 112 may be a centrifuge for separating the hydrocarbon diluent (light ends). The filter 112 is used to separate the hydrocarbon diluent from any water that may be introduced with the tar sands 102. From the filter 112, any water is carried through line 114 into tank 116*a*, and the hydrocarbon diluent is transferred from filter 112 through line 118 into tank 120.

Tar sands leaving the screw conveyor 106 are then transferred via line 122 to line 124. Line 198 carries the first aqueous solution from the tank 116*a* to be injected into the line 124 so that the composition in line 124 is about 30% to about 35% aqueous solution and about 65% to about 70% tar sands. Line 124 is provided with spaced injection ports for the injection of the first aqueous solution. Any line, such as line 124, carrying tar sands slurry may be provided with a series of injection nozzles along the length of the line and arranged in a helical pattern around the circumference of the line for the injection of aqueous solution that allows the sand to readily move in the line at low velocities. This reduces the wear and abrasion of lines because the sand is allowed to travel at a slower velocity. Additionally, any line having a bend may be provided with the injection nozzles located at the outer radius of the bend in the line so as to minimize abrasion at the outer radius of the bends in the lines where abrasion would normally be the greatest. The aqueous solution having a slightly raised specific gravity will move the tar sands through the line and at the same time the movement of the aqueous solution will assist in washing the oil from the sand releasing the hydrocarbons (crude oil) through attrition. An ultrasonic collar (not shown) fitted around the discharge slurry pipe can help to increase separation. The injection nozzles along the line are injected with aqueous solution to help turn the tar sand mixture to aid with washing and also to keep the sand from eroding the inside of the line or prevent settling on the bottom of the line. In conventional lines, the sand would need to move at a speed of about 10 feet per second; however, with the addition of the injection ports, the speed can be reduced significantly.

Line 124 feeds into a first settling vessel 126. The physical description of settling vessel 126 described herein may be applied to each of the settling vessels 126, 128, and 130 with modifications as noted. A settling vessel generally includes a vertically disposed elongated cylindrical body with a cone shape at the lowermost end thereof and a top cap at the uppermost end thereof. An angled plate or baffle separates the vessel into two compartments so that one compartment is at a higher elevation than the other. This allows the sand to drop to the bottom and allows the oil to rise and collect under the plate for removal. Settling vessels during operation are liquid filled and operate under pressure. This may eliminate the need for mechanical pumps to transfer the material forward. A settling vessel may include in addition to the inlet for the tar sand/aqueous solution, an inlet at the top cap for adding hydrocarbon diluent from tank 120, which is not being illustrated for brevity. A settling vessel generally includes four outlets to provide for four different fractions of liquid according to the respective specific gravity. A first outlet at or near to the top cap is for the collection of light ends, a second outlet lower than the first outlet and below the baffle is for collection of the crude oil, an approximately centrally disposed outlet is for collection of the aqueous solution, and a bottom outlet from the cone section is for collection of the sand or other material. The settling vessel 126 also includes an interior baffle 204. The baffle 204 is positioned directly above the outlet for the oil and divides the interior of the settling vessel into two compartments. For purposes of illustration, these will be denoted as a right compartment and a left compartment. The baffle 204 includes an angled portion and a vertical portion. The angled portion extends from above the outlet for the oil and terminates about midway between the outlet for the oil and the outlet for the aqueous solution. The baffle 204 then continues vertically down past the outlet for the water. The above dimensions are intended as a general guide and are not to be limiting. Further designs of the baffle and settling vessel are described below. In the settling vessel 126, as the tar sand/aqueous solution mixture enters into the left compartment, the mixture impinges on the angled section and has momentum. The baffle 204 guides the hydrocarbon/tar (crude oil) with a specific gravity lighter than water down the left compartment and around the end of the baffle into the right compartment where it will rise to the uppermost section of the right compartment having the outlet for the oil. The light ends will not have the momentum to go below the baffle, and thus, the light ends will rise and stay in the left compartment to the left of the baffle and be collected via the uppermost outlet in the top cap. The sand will fall to the bottom and be collected in the outlet from the cone section, and the aqueous solution will remain below the oil and be collected through the outlet between the outlet for the sand and the outlet for the oil. As discussed above, in the settling vessel 126 and subsequent settling vessels thereafter, the mixture of tar sands/aqueous solution will have a pH in the range of about 11.2 to about 12.0 and a specific gravity in the range of about 1.07 to about 1.01.

In settling vessel 126, the outlet for the light ends is connected to line 132, which feeds into separator 166. Separator 166 may be a centrifuge to separate respective "heavies" and respective "lights" from the light ends. Heavies comprising of aqueous solution are diverted from separator 166 through line 162 and transferred to the tank 116*a* or 116*b*. Lights comprising hydrocarbon diluent are carried from separator 166 through line 164 and returned to the tank 120. The outlet for the oil is immediately below the location where the baffle 204 connects to the inside of the settling vessel 126. Oil which collects beneath the baffle 204 is carried from the settling vessel 126 via line 134 to separator 152. The outlet for the first aqueous solution in settling vessel 126 is connected to line 136 to deliver aqueous solution to separator 168. The sand from settling vessel 126 is transferred via line 138 to the top inlet of a second settling vessel 128. Line 138 may be a specially designed slurry transfer line as described above.

At this point in line 138, the aqueous solution composition is changed to allow for the changing properties in the slurry and the composition is as described above. The second of two aqueous solutions is added to the line 138. The second aqueous solution is supplied from tank 178 through line 182 to the bottom of the settling vessel 126. The residual oil is washed from the sand, and as long as the sand is kept wet, the oil will not attach to the sand. The crude oil will thicken and cling to the sides of the line if the aqueous solution is not changed to halt this coating action. The second aqueous solution does not allow the oil to coat the inside of the lines. The second aqueous composition is stored in tank 178. The tank 178 has lines 182, 184, and 186 that deliver the second aqueous solution to the bottom of each of the three settling cylinders 126, 128, and 130 and/or to the lines 138, 146, and 188 that transfer sand slurry from the bottom of each settling vessel forward to the next settling vessel.

The second settling vessel 128 is in many respects similar to the first settling vessel 126 in construction and operation. The mixture of tar sands/aqueous solution entering the second settling vessel 128 will have a pH in the range of about 11.2 to about 12.0 and a specific gravity in the range of about 1.07 to about 1.01. The second settling vessel 128 includes a top outlet which is connected to line 140 for the removal of the light ends, a baffle 206 which includes an angled portion and a vertical portion is attached to the inside of the settling vessel 128 that divides the vessel into a right compartment and a left compartment. A second outlet for oil is located immediately below the connection of the baffle 206 to the inside of the settling vessel 128. The oil is carried via line 142 to the separator 152. The line 140 for light ends is connected to the line 142. The light oil in line 140 is mixed with the heavier oil, which can improve the quality and act as an aid for transporting. Alternatively, the light oil can be sent to a separate collection tank. The settling vessel 128 includes a third outlet for the second aqueous solution. The outlet for the second aqueous solution from settling vessel 128 is carried via line 144 to the separator 168. The settling vessel 128 includes a cone section at the lowermost portion of the settling vessel 128 to which line 146 is connected. The settling vessel 128 includes an outlet for sand at the bottom of the cone section. In settling vessel 128, the light ends collected off the top via line 140 are fed directly into line 142 which together feed into separator 152. The second aqueous solution collected from line 144 feeds into separator 168. The sand collected from line 146 enters the top of a third settling vessel 130. As with the first settling vessel 126, in the second settling vessel 128 the second aqueous solution from tank 178 is introduced to the slurry through the bottom of vessel 128. The amount of second aqueous solution added gives a composition in line 138 of about 45% to about 50% aqueous solution and about 50% to about 55% tar sands.

Settling vessel 130 is in many respects similar to the first and second settling vessels 126 and 128 in construction and operation. The second aqueous solution is supplied from tank 178 through line 186 to the bottom of the settling vessel 130. The mixture of tar sands/aqueous solution in the settling vessel 130 will have a pH in the range of about 11.2 to about 12.0 and a specific gravity in the range of about 1.07 to about 1.01. Settling vessel 130 includes a baffle 208 on the inside of the vessel including an angled portion and a vertical portion that divides the vessel into a right and a left compartment. The settling vessel 130 includes a first top outlet connected to line 148 and a second outlet directly beneath the baffle 208 for collecting the oil. The line 148 for light ends is connected to the line 150. The light oil in line 148 is mixed with the heavier oil, which can improve the quality and act as an aid for transporting. Alternatively, the light oil can be sent to a separate collection tank. The crude oil is carried via line 150 to separator 152. The settling vessel 130 includes a third outlet connected to line 204 for collecting the second aqueous solution. The line 204 carries the second aqueous solution to separator 168. The settling vessel 130 includes a cone section at the bottom of the cylindrical body of settling vessel 130. The cone includes a fourth outlet connected to line 188 for collecting sand. Line 188 carries the sand to separator 180. As with the first settling vessel 126 and the second settling vessel 128, in the third settling vessel 130 the second aqueous solution from tank 178 is introduced to the slurry through the bottom of vessel 130. The amount of second aqueous solution added gives a composition in line 188 from the bottom of settling vessel 130 of about 45% to about 50% aqueous solution and about 50% to about 55% tar sands.

While three settling vessels are illustrated, it is to be appreciated that fewer or additional settling vessels may be used depending on various factors, including the percentage of oil or water in the sand, and the aqueous solution composition, or the desired composition of the final crude oil product.

Separators 152, 168 and 180 may be centrifuges. Centrifugal force is advantageous on the enclosed pressurized aqueous solution and oil to reduce the residence time needed for settling and to allow for separation of the oil from the aqueous solutions. The system can be a closed system to allow pressurization and recovery of all the lighter hydrocarbons. Furthermore, centrifuges allow the process to be a continuous process compared to a batch process.

The first centrifuge 152 is used to clean the oil drawn from the pressurized settling vessels 126, 128, and 130 from outlets below the baffles. Centrifuge 152 will separate into four fractions. The higher percentage of hydrocarbons should be at the top third of the settling vessels and will be siphoned off. The liquid in this upper section of the settling vessels should be about 90% to about 100% crude oil. The oil/aqueous mixture at the top third of the settling vessels will be separated with the use of the centrifuge 152, which then sends the oil through a pressurized line 156 to the crude oil tank 176. The first aqueous solution separated in the centrifuge 152 will be recycled to tank 174 via line 158, which is then forwarded to tank **116*b* for pH and specific density measurement and adjustment, and finally to tank 116*a*. Any hydrocarbon diluent, which is the lightest fraction, separated in the centrifuge 152 will be recycled to tank 120 via line 154 and any sand or foreign particles, which is the heaviest fraction, will be transferred via line 160 to the sand pile 196 where it is stored at a staging area for resale or reclamation. Accordingly, separator 152 includes at least four outlets. From the lightest to heaviest fractions, these outlets are for hydrocarbon diluent, crude oil, first aqueous solution, and sand. A first outlet is connected to line 154 which carries light ends to the tank 120 for use as hydrocarbon diluent. A second outlet is connected to line 156. Line 156 carries crude oil from separator 152 to the crude oil tank 176. A third outlet from separator 152 is connected to line 158. Line 158 carries first aqueous solution from separator 152 to tank 174. A fourth outlet of separator 152 is connected to line 160. Line 160 transfers clean sand from separator 152 to the sand pile 196**.

A second centrifuge 168 will siphon off the second aqueous solution for recycling to tank 178 via line 172. The liquid drawn from the middle location in the settling vessels will be over 60% or more aqueous solution not including any oil or foreign particles. The centrifuge 168 will transfer the crude oil through a pressurized line 170 to the crude oil tank 176.

The centrifuge 168 recycles the second aqueous solution to tank 178, which is measured and adjusted for pH and specific density, and is then sent for use in the bottoms of vessels 126, 128, and 130, and or the lines 138, 146, and 188. Centrifuge 168 separates sand and other particles via line 174 and transfers the sand to the sand pile 196. Accordingly, centrifuge 168 includes at least three outlets. From the lightest to the heaviest fractions, these outlets are for crude oil, second aqueous solution, and sand. A first outlet is connected to line 170. Line 170 carries crude oil from the separator 168 to the crude oil tank 176. A second outlet of separator 168 is connected to line 172. Line 172 carries second aqueous solution from separator 168 to tank 178. A third outlet from separator 168 is connected to line 174. Line 174 carries clean sand from separator 168 to the sand pile 196.

A third centrifuge 180 will draw from the bottom of the settling vessel 130 to draw off the wet sand and dry the sand, while any aqueous solution or crude oil that is drawn with the sand will respectively be sent to second aqueous solution tank 178 or crude oil tank 176. Accordingly, centrifuge 180 includes at least three outlets. From the lightest to heaviest fractions, these outlets are for crude oil, second aqueous solution, and sand. A first outlet is connected to line 190. Line 190 carries crude oil from separator 180 to the crude oil tank 176. A second outlet of separator 180 is connected to line 192. Line 192 carries second aqueous solution from separator 180 to tank 178. A third outlet of separator 180 is connected to line 194. Line 194 carries clean sand from separator 180 to the clean sand pile 196.

Alternatively, one large centrifuge can replace the three centrifuges 152, 168, and 180 illustrated in the process but would not be as efficient. Using three centrifuges will reduce the volume of product going through any one centrifuge and also reduces downtime for maintenance and repair because one centrifuge can be shut down while two can be kept in production. A fourth centrifuge is recommended for redundancy to allow scheduled maintenance without any loss in production. A petroleum grade crude oil from the tar sands is collected under pressure so as to not lose any lighter petroleum ends. A portion of the lighter crude end can be drawn off the pressurized tank and returned to hopper 100 to be used as hydrocarbon diluent. The first and the second aqueous solutions are separated and collected for recycling back into tanks 174 and 178 where the aqueous solution may be tested for composition and adjusted for concentration before injection into the process. The sand and foreign particles will have been collected at a separate staging point where they will be graded for resale or reclamation.

Using the above-described system, about 90% to 100% of the crude oil will be collected using the illustrated system. The crude oil can be further refined into consumer goods, such as all grades of heating oil, diesel, gasoline, road base, and other like products. The refining of the crude oil into various consumer products is not described herein for brevity. The crude oil is stored in the crude oil tank 176. The sand that is collected in the sand pile 196 should be free of any hydrocarbons. The sand can be rinsed with water to remove any residual impurities.

In the above described process, a first and a second aqueous solution is used of varying compositions. The first aqueous solution is used in the hopper and first settling vessel, the second aqueous solution is used in subsequent settling vessels. The first and second aqueous solutions comprise a wetting agent and a specific gravity enhancing agent. A preferable wetting agent is sodium metasilicate pentahydrate. A preferable specific density enhancing agent is soda ash lite anhydrous. One embodiment of the first aqueous solution of tank 116 is made by adding to water about 20 to 68 grams, preferably about 34.5 grams of sodium metasilicate pentahydrate, about 2 to 7 grams, preferably about 3.5 grams of soda ash lite anhydrous, and about 0 to 7 grams, preferably about 5 grams of sodium bicarbonate anhydrous for every gallon of water (about 3781 grams) to make the concentrated solution. Then, 6.4 ml (about 128 drops) of the concentrated solution are added for every gallon of water to make the solution used in the process. Accordingly, the first aqueous solution used in the process has about 20 to 68 grams, preferably about 34.5 grams of sodium metasilicate pentahydrate, about 2 to 7 grams, preferably about 3.5 grams of soda ash lite anhydrous, and about 0 to 7 grams, preferably about 5 grams of sodium bicarbonate anhydrous for about every 2,242 kg of water. On a gram basis, this is approximately equal to adding about $9\times10^{-6}$ to about $3\times10^{-5}$ grams of sodium metasilicate pentahydrate and about $8.9\times10^{-7}$ to about $3.1\times10^{-6}$ grams of soda ash for every gram of water.

One embodiment of the second aqueous solution of tank 178 is made by adding to water about 0.7 to 30 grams, preferably about 15.1 grams (1/16 cup) of sodium metasilicate pentahydrate and about 7 to 14 grams, preferably about 11.3 grams (1 teaspoon) soda ash lite anhydrous for every gallon of water (about 3781 grams) to make the concentrated solution. Then, 3.85 ml of the concentrated solution are added for every gallon of water to make the solution used in the process. Accordingly, the second aqueous solution used in the process has about 0.7 to 30 grams, preferably about 15.1 grams (1/16 cup) of sodium metasilicate pentahydrate and about 7 to 14 grams, preferably about 11.3 grams (1 teaspoon) soda ash lite anhydrous for about every 3,724 kg of water. On a per gram basis, this is approximately equal to adding about $1.9\times10^{-7}$ to about $8.1\times10^{-6}$ grams of sodium metasilicate pentahydrate and about $1.9\times10^{-6}$ to about $3.8\times10^{-4}$ grams of soda ash for every gram of water.

The practical limits of operation of the above process exemplified in FIG. 1 are between about 40° Fahrenheit to about 100° Fahrenheit. The temperature of the sand does not seem to affect the effectiveness as long as the sand is not frozen. Frozen sand may require additional agitation to achieve optimum separation. The heating of the solution does not seem to affect the optimum separation, but the heat does not improve the separation process; therefore, it is not needed, and the cost of heat can be eliminated.

Figure 2:
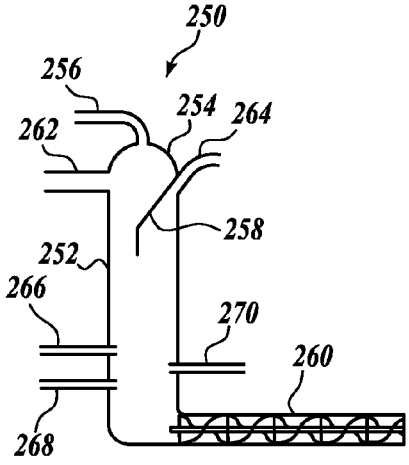
FIG. 2 is a diagrammatical illustration of a settling vessel in accordance with one embodiment of the present invention.
Figure 3:
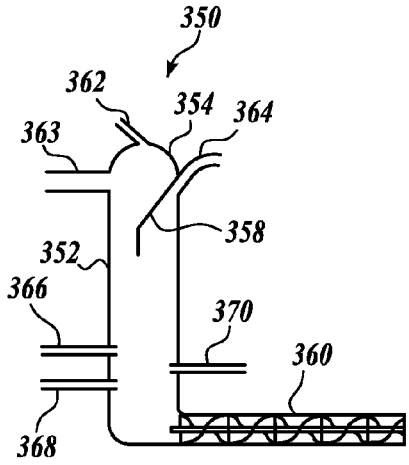
FIG. 3 is a diagrammatical illustration of a settling vessel in accordance with one embodiment of the present invention.

Referring to FIGS. 2 and 3, diagrammatical illustrations of representative settling vessels, such as for use as settling vessels 126, 128, and 130 are illustrated. Settling vessels 250 and 350 include a vertically disposed cylindrical tank 252, 352 over a majority of the height of the tank. The tank may be sealed on top via a dome lid 254, 354. In the center of the dome lid, a first outlet 256, 356 may be provided for the removal of light oils. A baffle 258, 358 is positioned inside of and attached to the cylinder body. An angled part of the baffle extends from a second nozzle at a lower height than the first outlet. The baffle extends inward and angled which is then connected to a vertical portion of the baffle. The angle of the baffle matches the angle made by the upper profile of the outlet so that the baffle is, in effect, continued by the outlet nozzle. The baffle divides the settling vessel into a right compartment and a left compartment. The settling vessels 250 and 350 include one or more outlets for the removal of any one of oil, aqueous solution, and sand. Aqueous solution, oil and tar sands are introduced via the inlets 262, 362 into the left compartment on the left side of the baffles 258, 358, respectively, of each settling vessel 250 and 350. As the aqueous solution enters the settling vessel, the aqueous solution has momentum that will carry the sand and oil to drop below the end of the vertical section of the baffle and cross from the left compartment into the right compartment. Oil will begin to rise and be collected on the right side of the baffle and be removed via outlets 264, 364, respectively, from each settling vessel. Aqueous solution will be removed via outlets 270 and 370, respectively, from each settling vessel 250 and 350. Aqueous solution may also be introduced by inlets 266, 268, 366, and 368 for additional agitation and washing of sand. Sand will settle to the bottom of the settling vessel and either be removed via pressure or via a screw conveyor 260, 360 as illustrated. Settling vessels may be designed to operate liquid filled and under pressure to eliminate the need for mechanical pumps to transfer liquids out of settling vessels.

Figure 7:
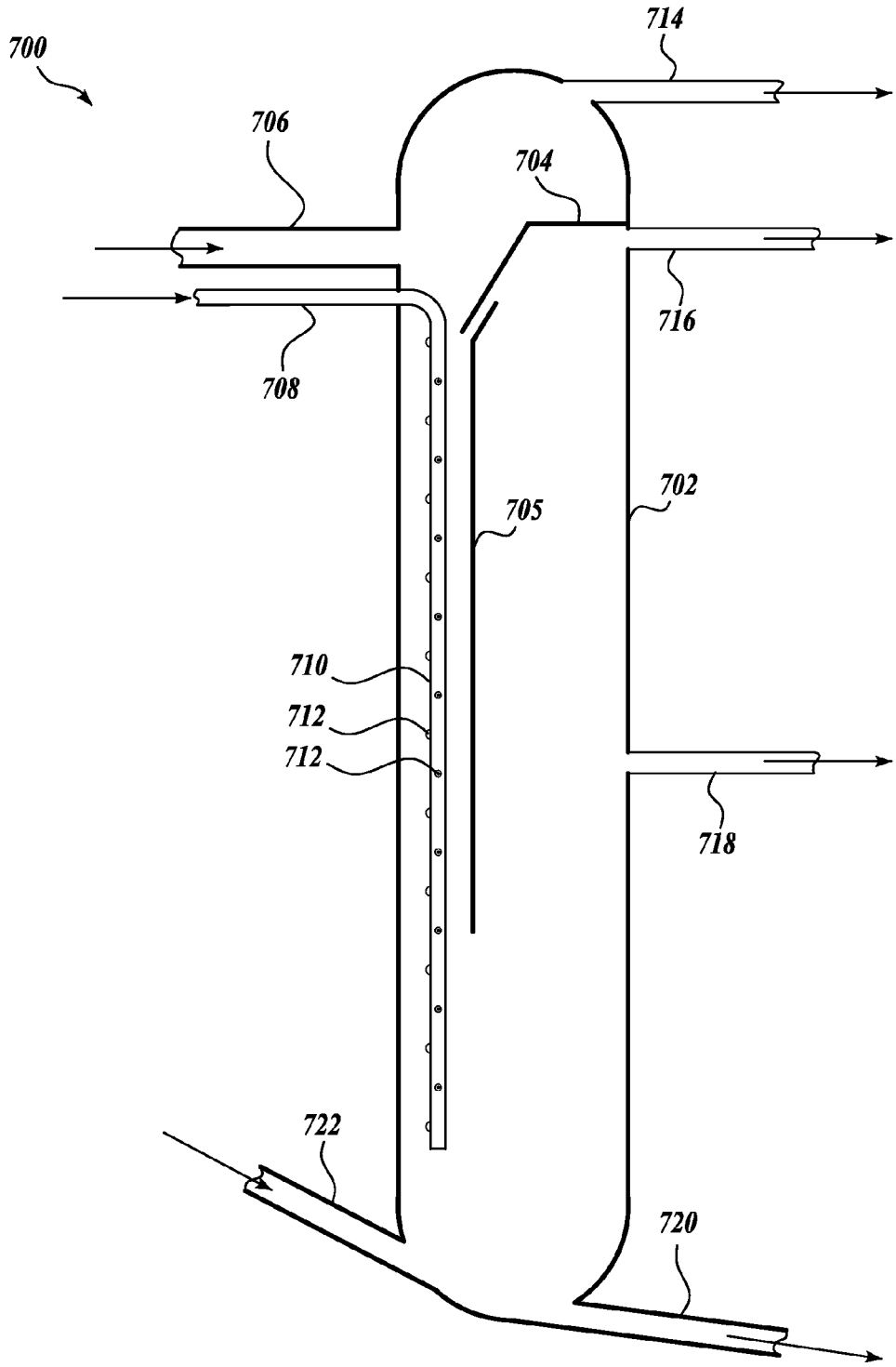
FIG. 7 is a diagrammatical illustration of a settling vessel in accordance with one embodiment of the present invention.

Referring to FIG. 7, another embodiment of a settling vessel 700 is illustrated. The settling vessel 700 includes a vertically disposed cylindrical tank 702. The tank 702 has a height that is greater than its diameter. The tank includes a domed top at the uppermost end of the tank, and the tank 702 includes a domed bottom at the lowermost end of the tank. However, the bottom may also include a cone-shaped bottom. The tank 702 includes a two-section baffle 704, 705 located within the interior of the tank 702 separating a first compartment from a second compartment. The first compartment may be defined as the space to the left of the baffle sections 704 and 705, the second compartment may be defined as the section of the tank to the right of the baffle sections 704 and 705. An outlet 714 exists in the first compartment, and a second outlet 716 exists in the second compartment. The first 714 and second 716 outlets are positioned at or about the uppermost area available within the respective first and second compartments. The baffle section 704 extends from a position at or immediately above the outlet 716. The baffle section 704 extends perpendicular to the inner wall of the tank 702 for about half the diameter of the tank. The baffle section 704 then has an angled portion angled downwardly for about the same distance as the straight portion of the baffle section 704. The baffle section 705 is positioned at or near to the end of the first baffle section 704 at the bottom. For example, in one embodiment, the second baffle section 705 can have a small portion that is at the same angle as the baffle section 704 extending downwardly, followed by a straight section that extends for more than half of the height of the tank 702. An outlet 718 is positioned on the tank at about the middle of the tank but may be higher or lower on the tank 702. The bottom portion of the tank 702 includes an outlet 720. Opposite to the outlet 720, an inlet 722 is provided. The inlet 722 is substantially aligned with the outlet 720 or at a slight angle with respect to the outlet 720. The tank 702 has an upper inlet 706. The inlet 706 is at or about the height of the angled portion of the first baffle section 704. An inlet 708 leads to a sparger tube 710. The sparger tube 710 is within the long, narrow vertical section of the first compartment and substantially parallel to the second baffle section 705. The sparger tube 710 extends for greater than half the height of the tank 702. The sparger tube 710 includes a plurality of nozzles 712. The nozzles 712 are spaced along the height and circumference of the sparger tube 710 to inject first or second aqueous solution in all directions in the area between the left side of the baffle section 705 and the interior wall of the tank 702. This is to provide mixing and agitation of the sand as it falls through the left compartment toward the bottom of the tank 702 and also provides momentum to the aqueous/oil mixture to carry the oil beyond the lower end of the baffle section 705 so that the oil can cross into the right compartment. The sparger tube 710 extends almost to the end of the tank 702 and terminates at or about the beginning of the dome bottom of the tank 702. The sparger tube 710 extends beyond the end of the lowermost end of the baffle section 705. As mentioned above, the baffle section 705 includes a parallel portion being parallel with the end of the angled portion of the baffle section 704. Between the angled portion of the baffle section 704 and the uppermost end of the baffle section 705, a small clearance gap is provided that leads from the left compartment to the right compartment. The clearance gap is at an angle generally allowing material to enter the right compartment from the left compartment as material rises upwardly. Also, the leftmost end of the angled portion of the baffle section 704 extends beyond the vertical portion of the baffle section 705 so as to trap any oil that may stay in the left compartment. This oil will rise toward the top and is trapped by the overhanging end of the angled portion of the baffle section 704.

The above-described settling vessels can provide for the separation of oil from an aqueous mixture. For example, by injecting tar sands with an aqueous mixture through inlet 706, the fractions to be separated include the light ends which will rise to the very top of the tank 702 in the left compartment and be removed via the outlet 714. The oil, water mixture, and sands have momentum that will carry them down the left compartment. As the oil/sand/aqueous mixture is carried by momentum downwardly in the tank, the sparger tube 710 applies a clean aqueous solution through the nozzles 712 to further agitate and remove the oil that is attached to the tar sands. The tar sands, oil, and water mixture continues falling via momentum until the very end of the baffle section 705, where the oil and water mixture will cross over and enter into the right compartment. The oil will rise to the very top of the right compartment which is bounded on the upper end by the baffle section 704. As the oil accumulates underneath the baffle section 704, the crude oil is removed via the outlet 716. Water being heavier than oil will accumulate at or about the middle of the tank 702 and be removed via the outlet 718. Sand, being the heaviest component, will be removed via the outlet 720 at the bottom of the tank 702. Clean solvent is injected via the inlet 722 where the stream of solvent is substantially aligned with the outlet 720 to further agitate and remove any oil remaining on the tar sands. As mentioned before, the sand, oil, and water mixture is carried via momentum downwardly through the left compartment. However, any oil that may begin to rise in the left compartment will be trapped by the overhanging baffle section 704 and pass through the gap between the baffle section 704 and the baffle section 705 and be removed via the outlet 716.

As described herein, a specially designed slurry line allows the oil and sand to be washed without dissolving the clays or derogating the sands. The oil sands are moved by way of these specially designed slurry lines that introduce the first aqueous solution to the tar sands as it moves to the first settling vessel. The slurry lines advantageously allow washing of the tar sands slurry while allowing forward movement of the slurry so as to minimize derogation of the grains of sand. This is an advantageous step to the process because the sand encapsulated in the oil is usually of very fine grain particles usually between 200 microns to 350 microns. The smaller the grains of sand the thinner the viscosity of the oil must be to allow the sand to drop out of suspension. If the sand is allowed to become even more derogated, the oil will need additional treatment to allow these fine sand particles to drop out of suspension. In addition, composite soil types in many of the tar sands deposits have high amounts of clays. These clays are compressed into larger particles that are then coated with the oil. If these clay particles are churned at high speed they will break down or dissolve into the oil and the aqueous solution creating a muddy bath that will become immersed with the oil and require additional treatment to be separated from the oil.

The heavy oils have a tendency to coat/collect on the inside wall of slurry lines, tanks, chambers and centrifuges causing the system to become restricted and eventually fail shutting down the process. This tendency has been eliminated by the use of the specially designed slurry line. The slurry line allows for continued washing of the lines with the aqueous solution that reduces the collection of the heavy oil on the inside of these lines. In addition, the slurry line allows for flushing the entire system with the aqueous solution for 5 minutes before starting the process and once every hour for 1 minute without any tar sands. The slurry lines also keep the sand from eroding the inside of the pipeline or settling on the bottom of the line.

Sand grains of the size that are found in tar sands deposits are normally very fine. When these fine sands are moved through a standard slurry line they will have a tendency to settle in the line if they are not moved at a rate of about 11 feet per second. In order to keep this settling from happening and eventually reducing the flow in the line if not plugging it, a specially designed slurry line is described. Using the slurry line described herein, the sand can be moved at about 6 feet per second or less without these problems. This means that if the washing time inside the slurry line of 30 seconds is desired, the slurry line will only need to be 150 feet rather than 330 feet. This will reduce the cost of construction because fewer feet of pipe are needed and less labor to construct the line is needed. Maintenance on the line is reduced by half because there is less than half the line to maintain.

The diameter of the slurry line will be determined by the volume of production and the number of settling vessels. For a 6,000 to 10,000 barrel per day production system, the line will be 6 to 10 inches with injection jets mounted every 6 inches in a spiral around the circumference of the line. On curves and bends in the line, the jets will additionally be placed to the outside of the curve to reduce the erosion of the line. This design may make it possible to use less expensive PVC pipe rather that heavy more costly steel pipe. The line may be installed at a slight slope to allow for gravity assistance to help move the sands. Aqueous solution will be injected into the line through the jets to turn the sand as well as move it along the line. This turning will assist in washing the oil from the sands and integrate it with the aqueous solution. After the sand leaves the hopper where a fine mist treatment with a hydrocarbon diluent/wetting agent is applied, the sand will move into the slurry line for hydro-transferring to the first settling vessel by way of this slurry line. It is in this first slurry line where the sand is first washed with the first aqueous solution. A second and third slurry line will also move the sands from the second and third settling vessels.

Figure 4:
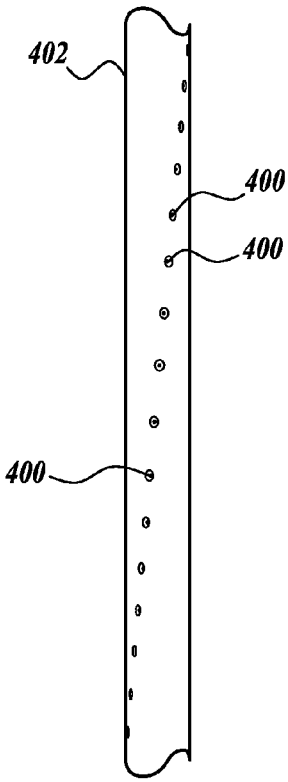
FIG. 4 is a diagrammatical illustration of a slurry transfer line in accordance with one embodiment of the present invention.
Figure 5:
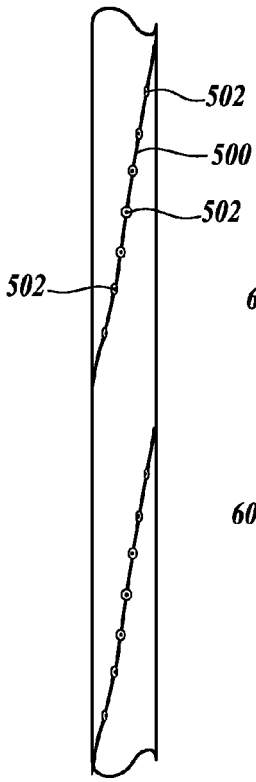
FIG. 5 is a diagrammatical illustration of a slurry transfer line in accordance with one embodiment of the present invention.
Figure 6:
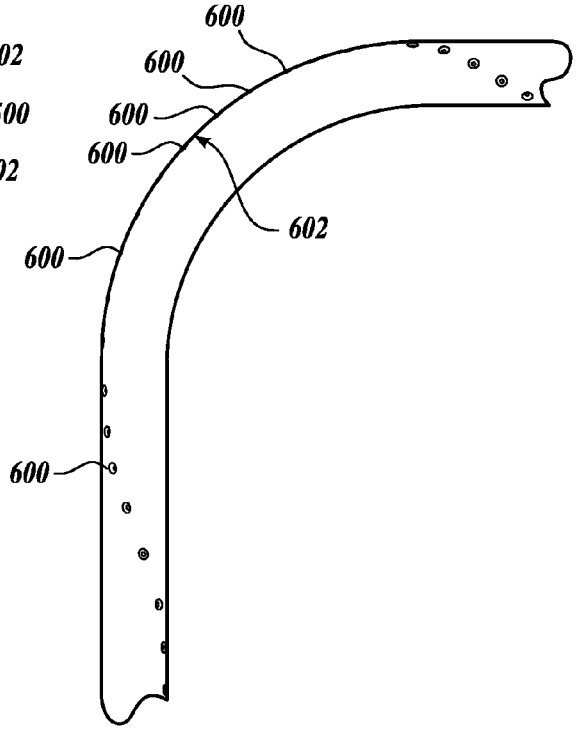
FIG. 6 is a diagrammatical illustration of a slurry transfer line in accordance with one embodiment of the present invention.

Referring to FIGS. 4-6, various embodiments of lines or pipes for the transfer of slurries, such as sand, shale, crushed shale, and other particulate materials, include a series of injection nozzles provided along the length of the pipe such that the nozzles are placed in a helical pattern around the circumference of the pipe and along the length of the pipe. Nozzles for injection may be positioned at an angle relative to the pipe to impart a forward momentum to the slurry being carried by the pipe. The nozzles, however, may inject aqueous solution at a right angle to the pipe or at an acute angle. The inside of the nozzles may be flush with the inside surface of the pipe. The injection action causes the slurry to be transferred in a forward direction along the pipe, as well as impart a washing action that assists in the separation of the oil from the sand. The helical pattern may supply momentum to churn or turn the sand slurry over as the sand slurry is transferred forward.

Referring specifically to FIG. 4, the nozzles may be spaced along the length of pipe 402 about 8 inches from nozzle to nozzle. However, the spacing may be greater or less depending on the particular conditions. A complete revolution may require about 3 feet 4 inches of pipe.

Referring to FIG. 5, a supply line 500 carries first or second aqueous solution to each of the nozzles 502 along the length of a section of pipe.

Referring specifically to FIG. 6, where any bend, such as an elbow of 90 degrees, exists in the pipes, the nozzles 600 may be located only on the outer radius 602 of the bend to prevent the material from abrading the corresponding inside outer radius of the pipe at the bend.

Pipe as illustrated in anyone of FIGS. 4, 5, and 6 may be used as the lines for transferring slurry in the process of FIG. 1. For example, lines 122, 124, 138, 146, and 188 may have nozzles for the injection of the first or second aqueous composition as described in association with FIGS. 4-6.

EXAMPLE 1

Three thousand and nine hundred (3,900) pounds of tar sands from Asphalt Ridge in eastern Utah, were crushed into approximately 1.5- to 2-inch diameter chunks. These 3,900 pounds of tar sands were loaded into a large concrete mixer. Into the mixer was added 163 gallons of a hydrocarbon diluent to reduce the internal fluid friction or viscosity of the oil layers surrounding each particle, and the mixer was set at medium speed and ran for 3 minutes. The hydrocarbon diluent was drained off and collected, totaling approximately 160+ gallons. Next, 240 gallons of the first aqueous solution of composition described in the application specification was added to wash the oil from the sand. The mixer was set at medium speed and ran for 10 minutes. The sand and aqueous solution was then transferred into a container (settling tank) where the mixture was allowed to settle. Approximately 2 gallons of mix was left in the concrete mixer. On the side of the settling tank was a Lucite viewing plate of approximately 30 inches by 4 inches used to observe the separating of tar sand and aqueous solution. Immediately, an inch of oil floating on the aqueous solution was observed. After ten minutes, a 9-inch layer of oil at the top of the aqueous solution was observed. From the test, 63 gallons (1.5 barrels) of crude oil was collected. The 240 gallons of aqueous solution was accounted for, and approximately 3,377 pounds of sand remained. A sample of the sand was collected and sent for analysis. The sand was found to be clean of any hydrocarbons (oil) and of a quality for use in the concrete and glass industries. The oil was tested, and the analysis was:

| | | |
|---|---|---|
| DESCRIPTION: | Tar sands | |
| GRAVITY: | 27.9 | |
| COLOR: | BLACK | |
| B.S. & W., % | .3 | |
| Lt. Naphtha | (I.B.P. to 200 F.) | 9.0 |
| Hvy. Naphtha | (200 F. to 390 F.) | 36.0 |
| Distillate | (390 F. to 525 F.) | 8.0 |
| Diesel | (525 F. to 580 F.) | 3.5 |
| Residue | (Above 580 F.) | 42.5 |
| Loss | | 1.0 |
| Total | | 100.0 |

EXAMPLE 2

Four clean and dry quart glass jars were designated with the letters A, B, C, and D. Jar A was not treated before the oil was added. To Jar B was added the second aqueous solution of composition described in the application specification and swirled around to wet the entire inside of the jar. To jar C was added tap water and swirled to coat the inside of the jar. To jar D was added the first aqueous solution of composition described in the application specification and swirled around to coat the inside of the jar. To the four jars were added 170 ml. samples of the separated oil from Example 1. The glass jars were capped and then turned to allow the oil to coat the inside of the jar. The jars were then allowed to stand for five minutes. After five minutes, the following was observed. Jar A was coated with the oil top to bottom. Jar B was clear of oil, and the oil was at the bottom of the jar. When the jar was turned, the oil did not coat or stick to the side of the jar. Jar C was coated with the oil top to bottom. Jar D had a thin oil film over the entire inside of the jar. After 24 hours, the following was observed. Jars A and C were still heavily coated by the oil, jar D was lightly coated with an oil film, and jar B was clear.

While illustrative embodiments have been illustrated and described, it will be appreciated that various changes can be made therein without departing from the spirit and scope of the invention.

The embodiments of the invention in which an exclusive property or privilege is claimed are defined as follows:

1. A settling vessel, comprising:

a tank;

a baffle within the tank dividing the tank at least partially into a first and second compartment, wherein one compartment extends higher in elevation in the tank than the other compartment, and the baffle extends between the two compartments throughout a portion of the height of the tank and terminates before the bottom of the tank to create a cross over region between the first and second compartments;

a first inlet to the tank, wherein the inlet is to the compartment that is higher in elevation in the tank;

a first outlet from the tank at or about the uppermost region of the first compartment; and a second outlet from the tank at or about the uppermost region of the second compartment;

wherein the baffle has a first and a second section, wherein the first section is defined by a straight portion extending perpendicular to the wall of the tank, followed by an angled portion extending downward, and the second section is defined by an angled portion partially substantially parallel to and below the angled portion of the first section, followed by a vertically straight portion extending downwardly in the tank.

2. The settling vessel of claim 1, wherein the angled portion of the first section extends beyond the vertically straight portion of the second section.

3. The settling vessel of claim 1, wherein a gap is provided between the angled portions to allow flow from the compartment higher in elevation to the other compartment and minimize flow in the opposite direction.

4. A system for separating oil from tar sands, comprising:

a settling vessel for separating oil from an aqueous mixture of oil, water and sand, the settling vessel comprising:

a tank;

a baffle disposed within the tank dividing the tank at least partially into a first and second compartment, wherein one compartment extends higher in elevation in the tank than the other compartment, and the baffle extends between the two compartments throughout a portion of the height of the tank and terminates before the bottom of the tank to create a cross over region between the first and second compartments;

a first inlet to the tank, wherein the inlet is to the compartment that is higher in elevation in the tank;

a first outlet from the tank at or about the uppermost region of the first compartment; and a second outlet from the tank at or about the uppermost region of the second compartment;

wherein the baffle has a first and a second section, wherein the first section is defined by a straight portion extending perpendicular to the wall of the tank, followed by an angled portion extending downward, and the second section is defined by an angled portion partially substantially parallel to and below the angled portion of the first section, followed by a vertically straight portion extending downwardly in the tank.

5. The system of claim 4, wherein the angled portion of the first section extends beyond the top of the vertically straight portion of the second section.

6. The system of claim 4, wherein a gap is provided between the angled portions to allow flow from the compartment higher in elevation to the other compartment and minimize flow in the opposite direction.

* * * * *